US006164851A

United States Patent [19]

Sakamoto et al.

[11] Patent Number: 6,164,851

[45] **Date of Patent: *Dec. 26, 2000**

[54] ROLL-SHAPED IMAGE-RECEIVING SHEET FOR THERMAL TRANSFER PRINTING AND PROCESS FOR FORMING IMAGES THEREON

[75] Inventors: Kenji Sakamoto; Kozo Odamura, both of Shinjuku-ku, Japan

[73] Assignee: Dai Nippon Printing Co., Ltd., Tokyo-to, Japan

[ * ] Notice: This patent is subject to a terminal disclaimer.

[21] Appl. No.: 09/401,546

[22] Filed: Sep. 22, 1999

Related U.S. Application Data

[62] Division of application No. 08/831,068, Apr. 1, 1997, Pat. No. 5,964,543.

[30] Foreign Application Priority Data

Apr. 3, 1996 [JP] Japan ..... 8-104782

[51] Int. Cl.[7] ..... B41J 35/28

[52] U.S. Cl. ..... 400/207; 400/120.01; 400/708

[58] Field of Search ..... 400/207, 224.2, 400/246, 619, 582, 586, 708, 120.01, 120.02, 120.03

[56] References Cited

U.S. PATENT DOCUMENTS

| | | | |
|---|---|---|---|
| 4,558,329 | 12/1985 | Honda | 400/241 X |
| 4,710,783 | 12/1987 | Caine et al. | 400/120.01 |
| 4,755,834 | 7/1988 | Kunimitsu et al. | 400/708 |
| 5,061,946 | 10/1991 | Helmbold et al. | 400/708 |
| 5,259,544 | 11/1993 | Hashimoto | 400/708 |
| 5,409,883 | 4/1995 | Larshus et al. | 400/240 |

FOREIGN PATENT DOCUMENTS 63-8971 1/1988 Japan .

*Primary Examiner*—John S. Hilten
*Assistant Examiner*—Minh H. Chau
*Attorney, Agent, or Firm*—Ladas & Parry

[57] ABSTRACT

A roll-shaped image-receiving sheet and process for forming an image therein. The sheet comprises a seal part having a color receptor layer, a substrate and an adhesive layer in this order and a peeling sheet applied to the adhesive layer so as to be peeled, and the seal part has a plurality of parts to be cut by a half-cut treatment in one image-receiving portion, each detection mark in the shape of a hole is formed at an interval of each image-receiving portion for indicating a starting position for formation of a printing-image. In the image forming process, the roll-shaped image-receiving sheet is formed for determining a starting-position for formation of a printing-image, a detector for detecting a detection mark on the image-receiving sheet in a printer is located along a transfer line of the detection mark, when the detection mark is detected by the detector, the image-receiving sheet is stopped to make a registration of an image forming position on the image-receiving sheet. An excellent and distinct image without a shift of each color image can be formed on the roll-shaped image-receiving sheet.

6 Claims, 8 Drawing Sheets

ROLL-SHAPED IMAGE-RECEIVING SHEET FOR THERMAL TRANSFER PRINTING AND PROCESS FOR FORMING IMAGES THEREON

CROSS REFERENCE TO RELATED APPLICATION

This application is a division of U.S. Ser. No. 08/831,068 filed Apr. 1, 1997, U.S. Pat. No. 5,964,543, which U.S. application is hereby incorporated herein by reference.

BACKGROUND OF THE INVENTION

The present invention relates to a roll-shaped Image-receiving sheet for thermal transfer printing and a process for forming an image thereon which is used for forming an image and a letter.

There are known various thermal transfer printing methods in which an image and a letter are transferred from a thermal transfer sheet with a color transfer layer on a substrate sheet to a surface of an image-receiving sheet, while the thermal transfer sheet is heated by a thermal head from the back-side of the thermal transfer sheet onto an image-receiving sheet.

These methods are roughly divided into two processes of a sublimation type thermal transfer printing method and a fusion type thermal transfer printing method in accordance with a construction of a color transfer layer. Both thermal transfer printing methods make it possible to form a full color image on a surface of image-receiving sheet. A full color image is formed in the following manner. For example, three or four thermal transfer sheets, that is, a yellow sheet, a magenta sheet, a cyan sheet, and a black sheet, if necessary, are prepared to pile up the image of each sheet onto the same surface of an image-receiving sheet.

With development of various hardware and software in connection with multi-media, the thermal transfer printing method is adapted for a hard copy system of full color for computer graphics, a stationary image for a satellite communication, a digital image for CD-ROM or the like and an analog image for video or the like to enlarge the market of the system.

An image-receiving sheet for thermal transfer printing used in the above mentioned method have various concrete uses. The sheet is typically used as a proof sheet for printing, an output sheet for image, an output sheet for a draft and a design in CAD/CAM and the like, a sheet for medical analysis instruments such as a CT(computerized tomography) scanner, an endoscope camera and the like, an output sheet for measurement instrument, a sheet for substitution of instant photograph, an output sheet for a face photograph onto identification card(ID card), credit card or the like, and various cards such as a sheet for a composite photograph on a souvenir picture in an amusement park, a game center, a museum, an aquarium and the like.

Further, with the diversificasion of uses described above, various sheets of label type, seal type, post card type and the like are developed. Then, a roll-shaped image-receiving sheet for thermal transfer printing is used as an image-receiving sheet in which the printing surface area of an image can be freely adjusted.

In an image-receiving sheet for thermal transfer printing as described above, for example, in the sheet of label type or seal type, a half cut treatment is previously done on an image receiving part to take off the image formed part from the sheet or perforations are previously formed along the circumference of the image receiving part to take off the image formed part therefrom. Further, in the sheet of post card type, a column for indicating a post code or a position for putting a postage stamp thereon is previously printed. Therefore, it is necessary to form an image on a predetermined position on the sheet.

However, a conventional roll-shaped image-receiving sheet has a problem that a thermal transfer image is deviated from a printing portion such as the half cut portion, the perforation forming portion or the stamp putting portion.

FIG. 12 is a schematic side view illustrating a conventional method of forming an image on an image-receiving sheet for thermal transfer printing. In FIG. 12, at first, a first dye layer of a thermal transfer sheet 122 is put on an image receiving position on the image-receiving sheet 120 by a thermal head 123 on a circumferential position of a platen roller 125 to print the image of a first color on the sheet 120 while the sheet 120 and the layer 122 are held between the thermal head 123 and the rotating platen roller. After that, the thermal head 123 is separated from the circumferential surface of the platen roller 125. In this state, the sheet 122 is moved forward by one pitch. In a second process, the image-receiving sheet 120 having a first image is rewound by a carrying roller 124 and a second image of a second color onto a first image is formed. At this time, a registration between the second image and the first image is done by adjusting a returned amount of the sheet 120 by the carrying roller 124.

When an image-receiving sheet cut in a proper size is used, the registration of an image on the sheet can be done by adjusting a returned amount of the sheet 120 by the carrying roller described above. However, in case that the image-receiving sheet in the form of a roll is used, a tension exerted on the carrying roller changes when the sheet 120 is moved because a diameter of a roll of the sheet remarkably changes between the start of transfer of the sheet and the end of transfer thereof. As a result, the carrying roller 124 is rotated loss motion (slip) to generate a shift of a returned amount of the sheet.

Further, in case that image-receiving sheets having different thickness or slippery property is used, the carrying roller 124 is rotated in a slipping manner to generate a shift of a returned amount of the sheet.

If a returned amount of the sheet shifts, a position of a first image is not registered with a position of a second image or later images. As a result, an image formed by the first image, the second image or later images becomes blurred.

Further, when a position of an image to be formed is defined by a half cut treating, a printing or the like on a surface of an image-receiving sheet, a position to form an image on the sheet is deviated from a position of an image actually formed on the sheet. As a result, the sheet is hardly used.

As the related arts of the above-mentioned techniques, Japanese Laid-Open Publication No.237691/1986, No.198497/1987 and No.890/1990 disclose an image-receiving sheet for thermal transfer printing in which a detection mark is formed on a back surface of the sheet. Japanese Utility Model Laid-Open Publication No.8971/1988 disclose a transparent sheet for thermal transfer printing in which a transparent detection hole for indicating a position for thermal transfer printing is formed.

Accordingly, for settling the problem, the object of the present invention is to provide a roll-shaped image-receiving sheet for thermal transfer printing and a process for forming an image onto a roll-shaped image-receiving sheet for thermal transfer printing in which a thermal transfer image is registered with a part previously printed such as a half cut portion, perforation forming portions a column for writing a postal code, and a position for putting a stamp, and each color image is registered with each other when each color image is formed to obtain a clear and high quality thermal transfer image.

SUMMARY OF THE INVENTION

In order to solve the above-mentioned problem, a roll-shaped image-receiving sheet for thermal transfer printing includes a detection mark formed on the image-receiving sheet for detecting a starting-position for formation of a thermal transfer printing image and a previously worked part on the image-receiving sheet. In this case, it is preferable that the detection mark is formed corresponding to each image-receiving portion or at an interval of a few of image-receiving portions, it is more preferable that the detection mark is a hole. Further, it is preferable that the detection mark is formed at a predetermined interval on a surface opposed to a color receptor layer of an image-receiving sheet.

It is preferable that the previously worked part has either a half cut portion, perforations or a printed line, and that the image-receiving sheet includes at least a seal part comprising a color receptor layer, a substrate sheet and an adhesive layer in this order, and the seal part is half-cut for peeling it. In this case, it is preferable that the roll-shaped image-receiving sheet comprises at least a seal part having a color receptor layer, a substrate and an adhesive layer in this order and a peeling sheet applied to the adhesive layer so as to be peeled, that the seal part has a plurality of parts to be cut by a half-cut treatment in one image-receiving portion, and that each detection mark in the shape of a hole is formed at an interval of each image-receiving portion for indicating a starting position for formation of a printing-image.

A process for forming an image onto a roll-shaped image-receiving sheet for thermal transfer printing, the roll-shaped image-receiving sheet is formed for determining a starting-position for formation of a printing-image, a detector for detecting a detection mark on the image-receiving sheet in a printer is located along a transfer line of the detection mark, when the detection mark is detected by the detector, the image-receiving sheet is stopped to make, a registration of an image forming position on the image-receiving sheet, and an image is then formed by sublimation type thermal transfer printing. In this case, it is preferable that a color image is formed by piling up at least a yellow-image, a magenta-image and a cyan-image by the sublimation-type thermal transfer printing.

According to the present invention as described above in detail, an excellent and distinct image without a shift of each color image can be formed on a roll-shaped image-receiving sheet since a detection mark is formed on the sheet for indicating a formation starting position of a thermal transfer image. Further, the roll-shaped thermal transfer image-receiving sheet according to this invention has a previously worked part such as a half cut portion, a perforation portion, and a printing portion of a postal code writing column and a stamp applying position, and the previous worked portion is reliably registered with a thermal transfer image. In addition, a detection mark can function to detect the cutting position when the sheet is cut after printing a letter or forming an image.

And, according to the above process for forming an image onto a roll-shaped image-receiving sheet for thermal transfer printing, the image receiving position of the roll-shaped thermal transfer image-receiving sheet having a detection mark is detected by the detector to be registered with the thermal transfer sheet. Thus, even in case that a roll-shaped image-receiving sheet in which a tension exerted on a carrying roller changes at a carrying time of the sheet, an image without a shift can be formed at a predetermined position. A detection mark can be used as a reference for determining the cutting position of the image-receiving sheet.

DESCRIPTION OF THE PREFERRED EMBODIMENTS

A roll-shaped image-receiving sheet for thermal transfer printing will now be explained with reference to preferred embodiments of the sheet.

Figure 1:
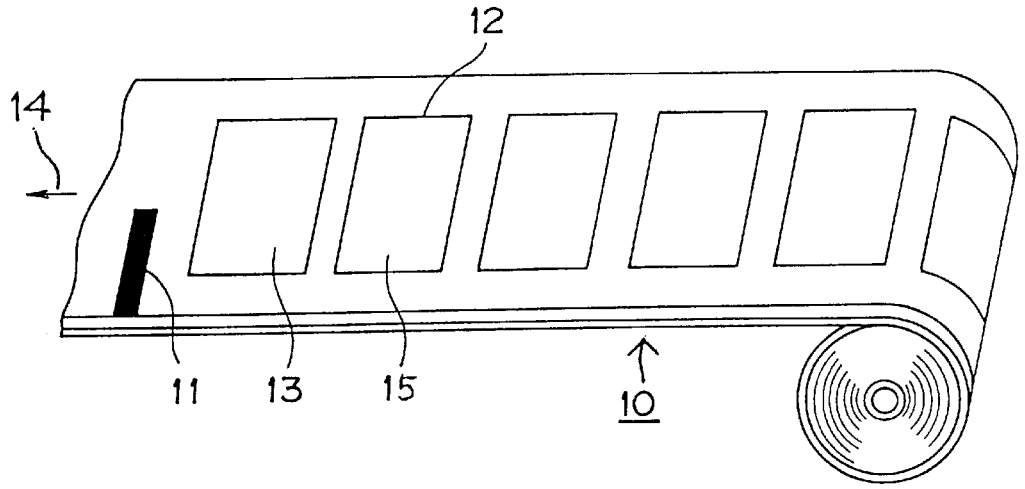
FIG. 1 is a schematic perspective view illustrating a first embodiment of a roll-shaped image-receiving sheet for thermal transfer printing of the present invention.

FIG. 1 is a schematic perspective view illustrating a first embodiment of a roll-shaped image-receiving sheet for thermal transfer printing. In FIG. 1, a detection mark 11 is formed by printing at one side end of the sheet in front of a first image receiving part 13 on an image-receiving sheet 10. A number of image receiving parts are formed along the moving direction of the sheet 10 and each image receiving part is treated in a special manner (half cut treatment mentioned hereinafter). A half cut line 12 is formed at the circumference of each image-receiving part. The detection mark 11 may be a hole on the sheet 10.

Figure 2:
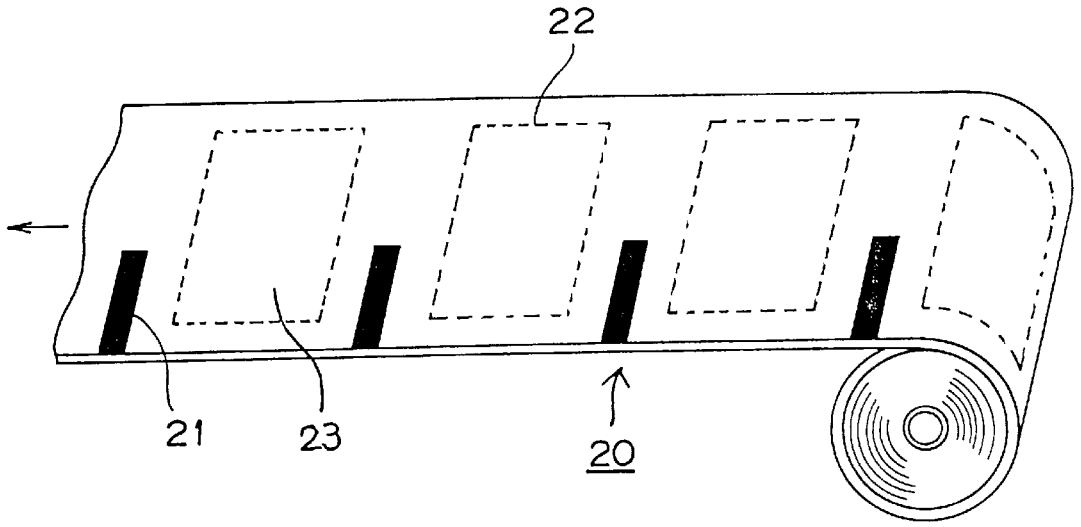
FIG. 2 is a schematic perspective view illustrating a second embodiment of a roll-shaped image-receiving sheet for thermal transfer printing of the present invention.

FIG. 2 is a schematic perspective view illustrating a second embodiment of a roll-shaped image-receiving sheet for thermal transfer printing. In FIG. 2, a detection mark 21 is formed by printing, corresponding to each image-receiving part 23 on the sheet 20. Each image-receiving part 23 is defined by a series of perforations 22. Each detection mark 21 may be a hole in the same manner as described in FIG. 1.

Figure 3:
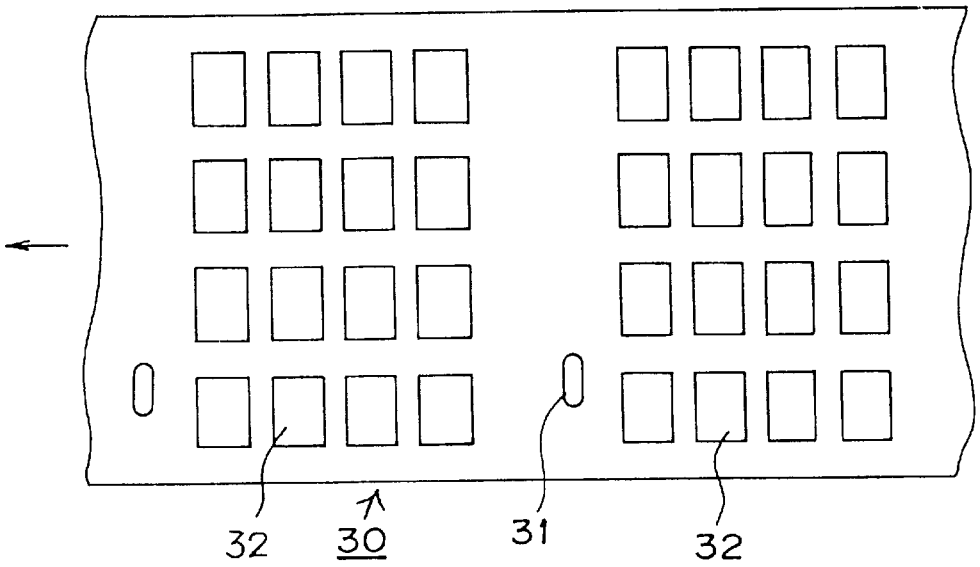
FIG. 3 is a schematic plan view illustrating a third embodiment of a roll-shaped image-receiving sheet for thermal transfer printing of the present invention.

FIG. 3 is a schematic plan view illustrating a third embodiment of a roll-shaped image-receiving sheet for thermal transfer printing. In FIG. 3, a penetrating hole 31 is formed between two groups each having a plurality of image receiving parts 32. For example, sixteen image-receiving parts 32 are made in each group. Each image-receiving part 32 is treated in the half cut manner mentioned hereinafter in detail.

Figure 4:
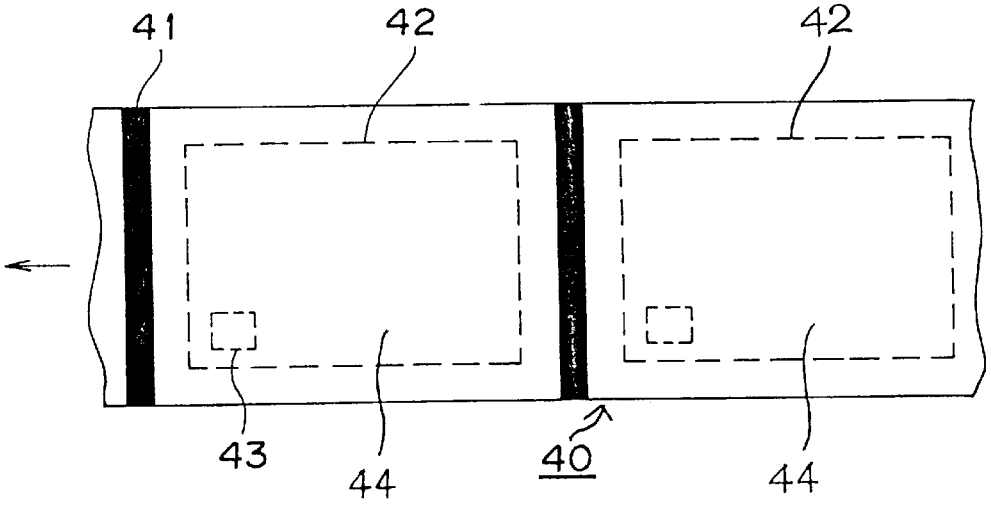
FIG. 4 is a schematic plan view illustrating a fourth embodiment of a roll-shaped image-receiving sheet for thermal transfer printing of the present invention.

FIG. 4 is a schematic plan view illustrating a fourth embodiment of a roll-shaped image-receiving sheet for thermal transfer printing. In FIG. 4, a detection mark 41 is made across the sheet 40 between two image receiving part 42, 42 each of which is defined by perforations in the form of a post card and has a position 43 for a postage stamp.

Figure 5:
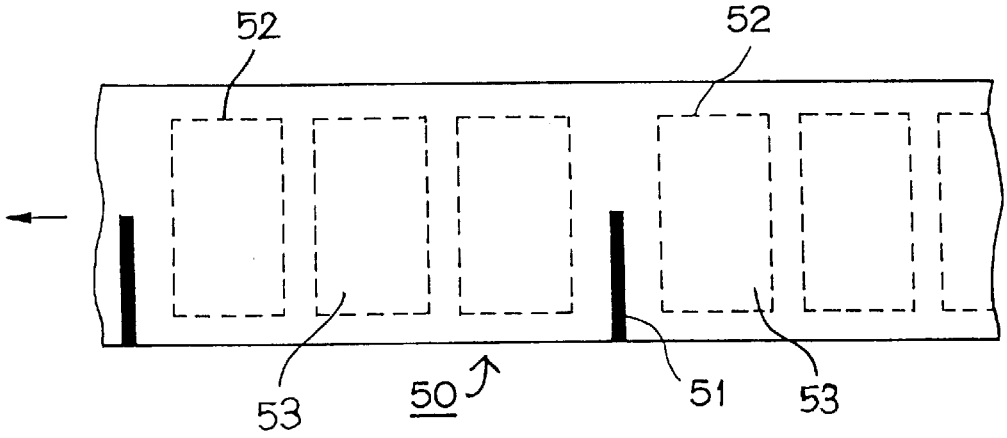
FIG. 5 is a schematic plan view illustrating a fifth embodiment of a roll-shaped image-receiving sheet for thermal transfer printing of the present invention.

FIG. 5 is a schematic plan view illustrating a fifth embodiment of a roll-shaped image-receiving sheet for thermal transfer printing. In FIG. 5, a detection mark 51 is made at an interval of three image-receiving parts on the sheet 50, and cutting lines 52 are formed at a predetermined interval on the sheet 50 to form a card.

Figure 6:
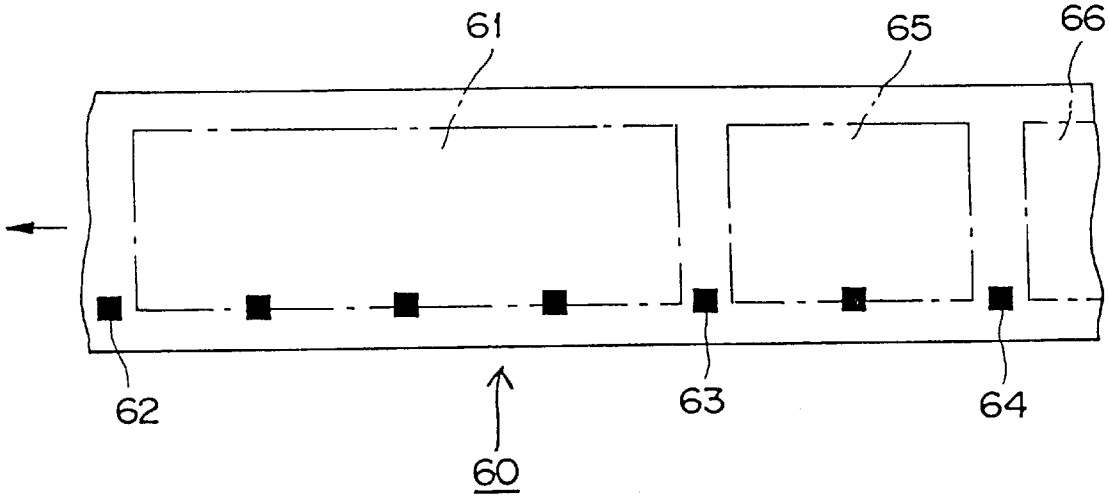
FIG. 6 is a schematic plan view illustrating a sixth embodiment of a roll-shaped image-receiving sheet for thermal transfer printing of the present invention.

FIG. 6 is a schematic plan view illustrating a sixth embodiment of a roll-shaped image-receiving sheet for thermal transfer printing. In FIG. 6, each of detection marks 62,63,64 is made at a predetermined pitch on the sheet 60, and image-receiving parts 61,65,66 have different sizes on the sheet 60.

Figure 15:
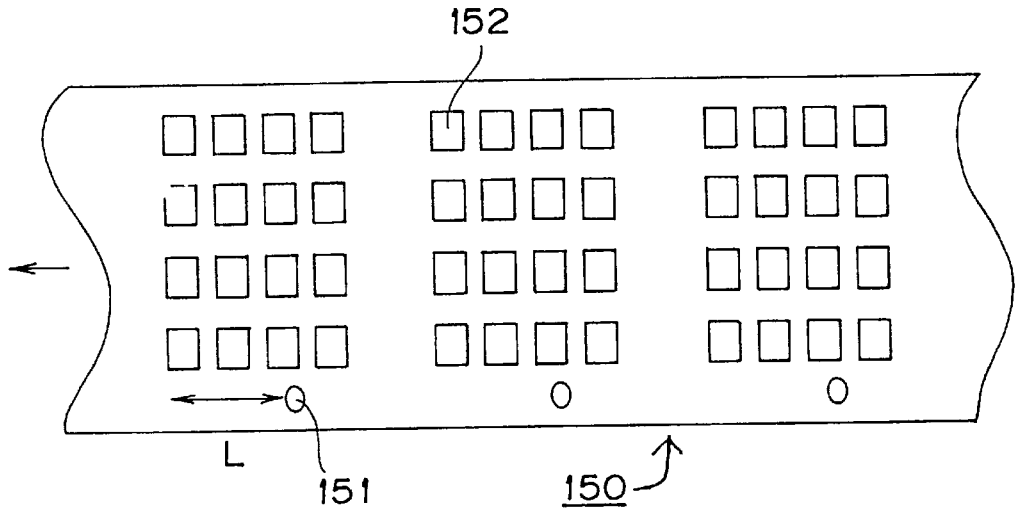
FIG. 15 is a schematic plan view illustrating a ninth embodiment of a roll-shaped image-receiving sheet for thermal transfer printing of the present invention.

Further, FIG. 15 is a schematic plan view illustrating a ninth embodiment of a roll-shaped image-receiving sheet for thermal transfer printing. In FIG. 15, each detection mark 151 is made at a predetermined position and interval under a group of image-receiving parts 152 on the sheet 150.

Next, the construction of the image-receiving sheet will now be explained.

(Substrate Sheet)

A substrate for each of the roll-shaped image-receiving sheets (10, 20, 30, 40, 50, 60, 70, 80, 90, 110, 120, 130, 140, 150) mentioned above for thermal transfer printing may be conventional substrate for a conventionally used sheet. However, other substrates may be used.

As the substrate, synthetic paper, fine paper, art paper, coat paper, cast-coated paper, plastic film, foaming film and the like can be used. A laminated composition substrate comprising a plurality of substrates described above may be used.

As the plastic film, polyolefin such as polyethylene, polypropylene or the like, polyester such as polyethylene terephthalate, polyethylene naphthalate or the like, polyvinyl chloride, polystyrene, polymethyl methacrylate, polyearbonate, cellophane, cellulose acetate, polyacrylate, polyarylate, polyethersulfone and the like may be used. Particularly, if the sheet is used for an overhead-projector (OHP), a plastic film of high transparency is selected from plastic films described above.

If a transparency is not necessary in the case of other uses except an OHP sheet, an opaque plastic film or a paper is used.

A laminated combination substrate formed by piling up more than two kinds of films is preferable in such a case. For example, a preferable laminated combination substrate, that is, a substrate formed by laminating a polypropylene film with microvoid on one or both surfaces of a paper or a plastic film can be used. In addition, a substrate formed by laminating one selected from either a paper or a plastic film on a film in which each thin layer without microvoid is laminated on both surfaces of polypropylene film with microvoid.

It is preferable to limit the thickness of the substrate within a range from approximately 50 to 200 $\mu$m in consideration with a strength and an use of the image-receiving sheet and, however, the thickness thereof is not necessarily limited to the range.

If necessary, a primer treatment or a corona discharging treatment as a conventional adhesion treatment may be applied to the surface of the substrate.

(Color Receptor Layer)

A color receptor layer may be formed on one surface of the substrate directly or via a primer treatment layer formed on the substrate indirectly. The constitution of the color receptor layer differs in accordance with a different recording manner of either sublimation type thermal transfer printing or fusion type thermal transfer printing. In the case of the fusion type thermal transfer printing, a color transferring layer is directly transferred on the substrate without a color receptor layer.

A color receptor layer of each of the fusion type and sublimation type thermal transfer printings has a function to receive a color agent transferred by the heat of a thermal head from the thermal transfer sheet. Therefore, in the case of a color agent being a sublimate dye, it is preferable that a color receptor layer receives and developes the dye and, however, at this time, the received dye is not resublimated. This color receptor layer mainly comprises the following resins for a color receptor layer. As resins for a color receptor layer, a resin with ester linkage, a resin with amido linkage, a resin with urea linkage, a resin with urethane linkage, a resin with high polarity linkage, a mixture of resins described above and a copolymer resin of resins described above, and the like can be used. Especially, a mixture of an ethylene-vinyl acetate copolymer and a polyvinyl chloride is preferable.

If necessary, either an organic or inorganic filler may be added to the color receptor layer comprising the resins described above. In case of the sublimation type thermal transfer printing, furthermore, a release agent may be added into a resin described above to improve a thermal-peeling property of the color receptor layer on the thermal transferring sheet.

A color receptor layer for both fusion type and sublimation type thermal transfer printing may be formed as following; an assistant agent of any kinds is added to the above resins, if necessary, and the assistant agent and the resins are dissolved or dispersed in a suitable solvent to obtain a composition material. The composition material is applied onto a substrate by a known method, that is, gravure printing method, screen printing method, reverse roll coating method with a gravure printing plate or the like, and is then dried.

The thickness of a color receptor layer in a state of drying is normally from 0.1 to 10 μm.

(Image-receiving Sheet for Seal Use)

In case that an image formed on the roll-shaped image-receiving sheet of the present invention is peeled therefrom to put the peeled image on something when it is used (seal use), a seal or label for seal use basically comprises a release sheet, an adhesive layer, a substrate described above and a color receptor layer as described above in this order. The constitution of the sheet is explained below.

Release Sheet

A sheet in which a known release agent of silicone or the like is applied to a surface of either a known plastic film of polyethylene terephthalate and the like or known polylaminated paper can be used as a release sheet. As the materials of the release sheet, "RUMILAR T-60" film with a thickness of 50 μm manufactured by TORAI Inc., "W-400" film with a thickness of 38 μm manufactured by DAIAFOIL Inc. and the like may be used. The preferable thickness of the release sheet is in a range of 20 to 100 μm. If a release sheet is too thin, an obtained image-receiving sheet can not be properly carried in a thermal printer and may have wrinkles because of its small hardness. If a release sheet is too thick, an obtained image-receiving sheet damages a printer and can not be carried in a normal state in the printer since the thermal transfer printer needs much power for carrying the sheet.

As a release sheet, a polyolefin film without surface treatment, for example, a drawing or non-drawing polyethylene film and a drawing or non-drawing polypropylene film can be used. A drawing or non-drawing polypropylene film is preferable.

Judging from the inventor of this invention, when a surface of a drawing or non-drawing polypropylene film without release treatment is coated with a properly selected adhesive layer, even if the surface of the film is under the release treatment, a peeling strength between an adhesive layer and a drawing or non-drawing polypropylene film can be easily adjusted in the range of 100 to 2500 g, preferably, 700 to 2000 g. The peeling strength is measured at 180° on the basis of Japanese Industrial Standard No.Z-237. When a roll-shaped image-receiving sheet is manufactured, an unnecessary area without images can be easily peeled from the substrate by adjusting the peeling strength at the above range. Even if the half cut treatment is made in the color receptor layer, a separation of a substrate never happens when an image is formed. Each image forming portion can be peeled from a substrate after an image is formed.

The thickness of the drawing or non-drawing polypropylene film is in the range of 20 to 100 μm, preferably 35 to 75 μm. These polypropylene films can be obtained from a market. "PYLENE" film is manufactured by TOYOBOSEKI Inc., "TOLEFAN" film is manufactured by TORAI Inc..

Adhesive Layer

A known adhesive agent of either solvent-type or aqua-type can be used for an adhesive layer. For example, vinyl-acetate resin, acrylic resin, vinyl acetate-acrylic copolymer, vinyl acetate-vinyl chloride copolymer, ethylene-vinyl acetate copolymer, polyurethane resin, natural rubber, polychloroprene rubber, nitrile rubber and the like may be used for material of the adhesive layer.

An applied amount of the adhesive agent for the adhesive layer on a release sheet is normally in the range of approximately 8 to 30 g/m$^2$ (solid content). An adhesive layer is formed by known methods such as gravure coating method, gravure reverse coating method, roll coating method and the like. An adhesive agent is applied to the release sheet by these methods and is then dried to form the adhesive layer.

An adhesive agent for an adhesive layer must be selected so as to have a favorable adhesive force against a substrate, and to have a peeling strength in the above-mentioned range against a release layer.

Substrate

In case that the obtained roll-shaped image-receiving sheet is used for a seal to be put on something, a substrate material is selected from among the above-mentioned "substrates", the following materials are especially preferable, that is, a polypropylene film with microvoid such as "TOYOPARL SS-P4255" film with a thickness of 35 μm manufactured by TOYOBOSEKI Inc., "MW247" film with a thickness of 35 μm manufactured by MOBIL PLASTIC EUROPE Inc. and the like or a polyethylene terephthalate film with microvoid such as "W-900" film with a thickness of 50 μm by manufactured by DAIAFOIL Inc., or "E-60" film with a thickness of 50 μm manufactured by TORAI Inc., and the like.

Figure 8:
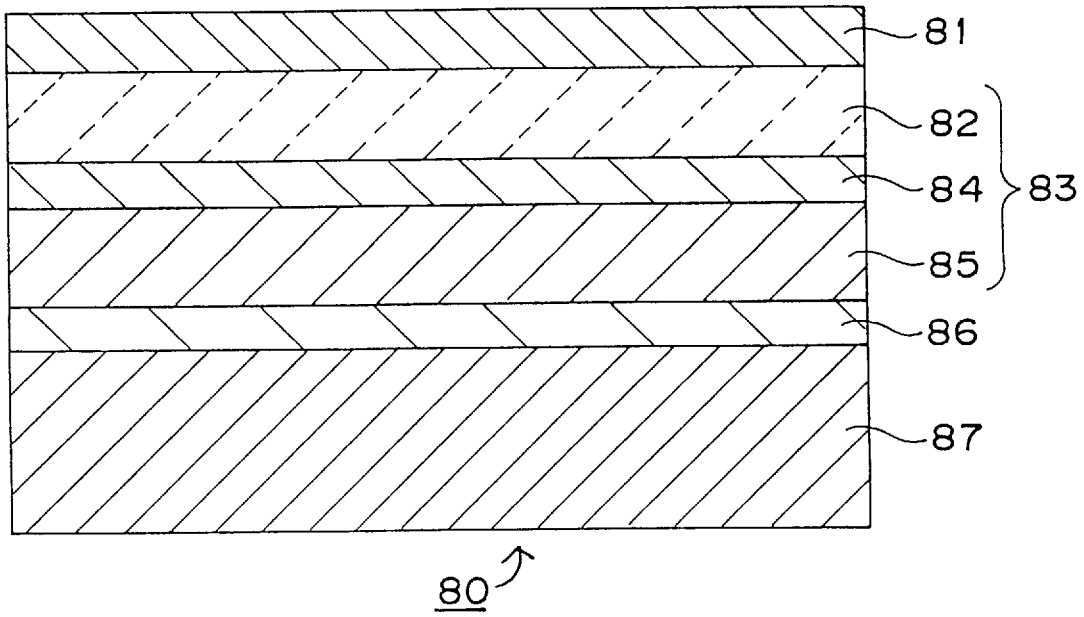
FIG. 8 is a schematic enlarged cross sectional view illustrating another embodiment of constitution of a roll-shaped image-receiving sheet for thermal transfer printing of the present invention.

FIG. 8 is a schematic enlarged cross sectional view illustrating another embodiment of constitution of a roll-shaped image-receiving sheet for thermal transfer printing of the present invention. FIG. 8 shows the most preferable embodiment in the present invention.

A substrate 83 comprises a laminated film in which a resin film 82 with microvoid is laminated onto a resin film 85 without microvoid via an adhesive layer 84. A color receptor layer 81 is formed on the resin film 82 with microvoid, the adhesive layer 86 is formed on the resin film 85 without microvoid, and a release sheet 87 is applied onto the adhesive layer 86. According to the construction of the substrate, a developing color depth of dark color part of the formed image can be improved to obtain a high quality image.

As the resin film 85 without microvoid, polyethylene terephthalate film, polyethylene film, polypropylene film and so on can be used. A known resin film without microvoid may be used. The thickness of the resin film 85 is preferably in the range of approximately 10 to 50 μm. If the resin sheet 85 is too thin, an obtained image-receiving sheet has a small hardness and shrinks under the influence of the heat of a thermal head to generate a curl. If the resin sheet 85 is too thick, an obtained image-receiving sheet curls easily under the influence of the heat of the thermal head and the like at the time of forming images. A preferable resin film is "RUMILAR S-10" film with a thickness of 12 μm manufactured by TORAI Inc..

A known polypropylene film with microvoid, a known polyethylene terephthalate film and so on may be used as the film 82 with microvoid. Especially, since a polypropylene film with microvoid has a good elasticity and heat insulating property, a dye on the thermal transfer sheet can be transferred uniformly and efficiently onto the color receptor layer 81 on an image-receiving sheet while contacting the thermal head. The preferable thickness of the above-mentioned resin film 82 is in the range of approximately 30 to 60 μm. Preferable resin films are "TOYOPARL P4255" film of a thickness of 35 μm or "TOYOPARL P4256" film of a thickness of 60 μm manufactured by TOYOBOSEKI Inc..

The lamination of the resin film 85 without microvoid and the resin film 82 with microvoid described above may be done by conventional lamination methods such as dry lamination, non-solvent (hot melt) lamination, EC lamination and the like. A preferable adhesive agent in case of non-solvent lamination is "TAKENEIT A-720L" manufactured by TAKEDA YAKUHIN KOGYO Inc.. A preferable adhesive agent in case of dry lamination method is "TAKELUCK A969/TAKENEIT A-5 (3/1)" manufactured by TAKEDA YAKUHIN KOGYO Inc.. The applied amount of these adhesive agents for laminating two resin films 82,85 is in the range of 1 to 8 g/m$^2$ (solid content) preferably, 2 to 6 g/m$^2$.

Process

A process for forming a roll-shaped image-receiving sheet as a seal use will now be explained.

Figure 9:
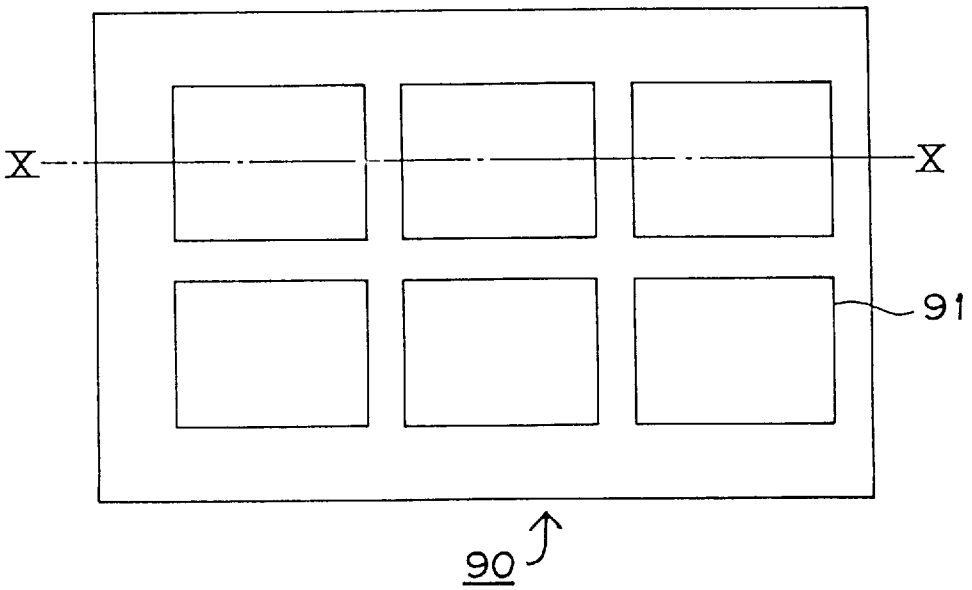
FIG. 9 is a schematic plan view illustrating a seventh embodiment of a roll-shaped image-receiving sheet for thermal transfer printing of the present invention.
Figure 10:
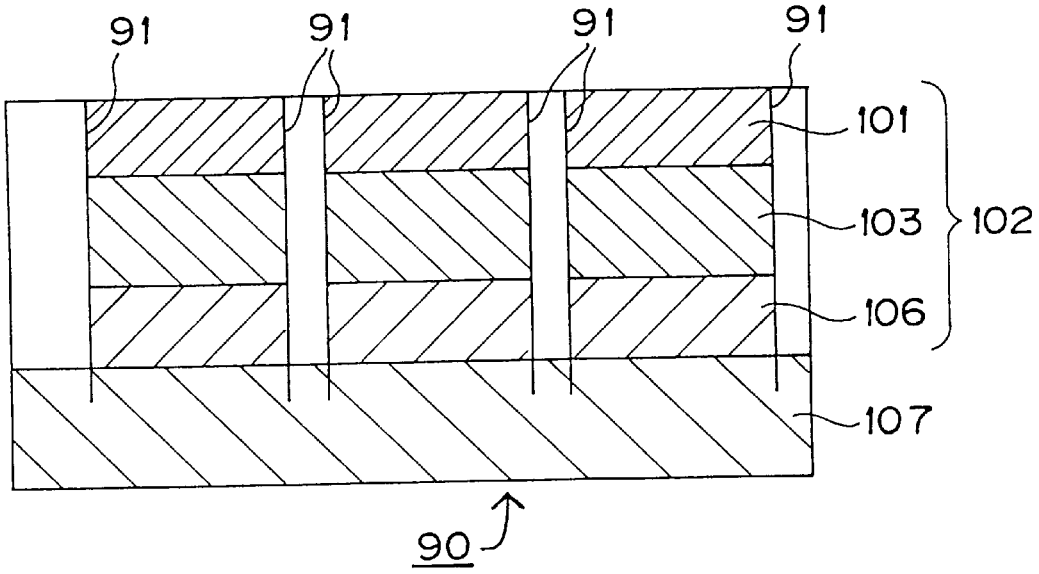
FIG. 10 is a schematic enlarged cross sectional view illustrating a seventh embodiment in FIG. 9 of a roll-shaped image-receiving sheet for thermal transfer printing of the present invention.

FIG. 9 is a schematic plan view illustrating a seventh embodiment of a roll-shaped image-receiving sheet for thermal transfer printing of the present invention. FIG. 10 is a schematic enlarged cross sectional view illustrating a seventh embodiment in FIG. 9.

At first, a coating material for forming a color receptor layer 101 is applied onto one surface of a substrate 103 by gravure coating method or the like. The coated layer is dried to form the color receptor layer 101. Next, a coating material for forming an adhesive layer 106 is applied onto the other surface of the substrate 103 by gravure coating method or the like. The coated layer is dried to form the adhesive layer 106. After that, the adhesive layer 106 of the substrate 103 and the release sheet 107 are laminated with each other to form an image-receiving sheet 90 for thermal transfer printing in which the release sheet 107, the adhesive layer 106, the substrate 103 and the color receptor layer 101 are laminated in this order. The above-mentioned sheet 90 in FIG. 10 may be prepared by the lamination of the substrate 103 without the adhesive layer 106 and the release sheet 107 with the adhesive layer 106.

The sheet 90 has cutting lines 91 along which a seal part 102 is peeled off from the release sheet 107. the cutting lines extend from the color receptor layer 101 to the release sheet 107. It is preferable that the cutting line 91 extends deeply to the boundary-surface between the adhesive layer 106 and the release sheet 107, or up to the inner side of the release sheet 107 from the boundary-surface.

Figure 11:
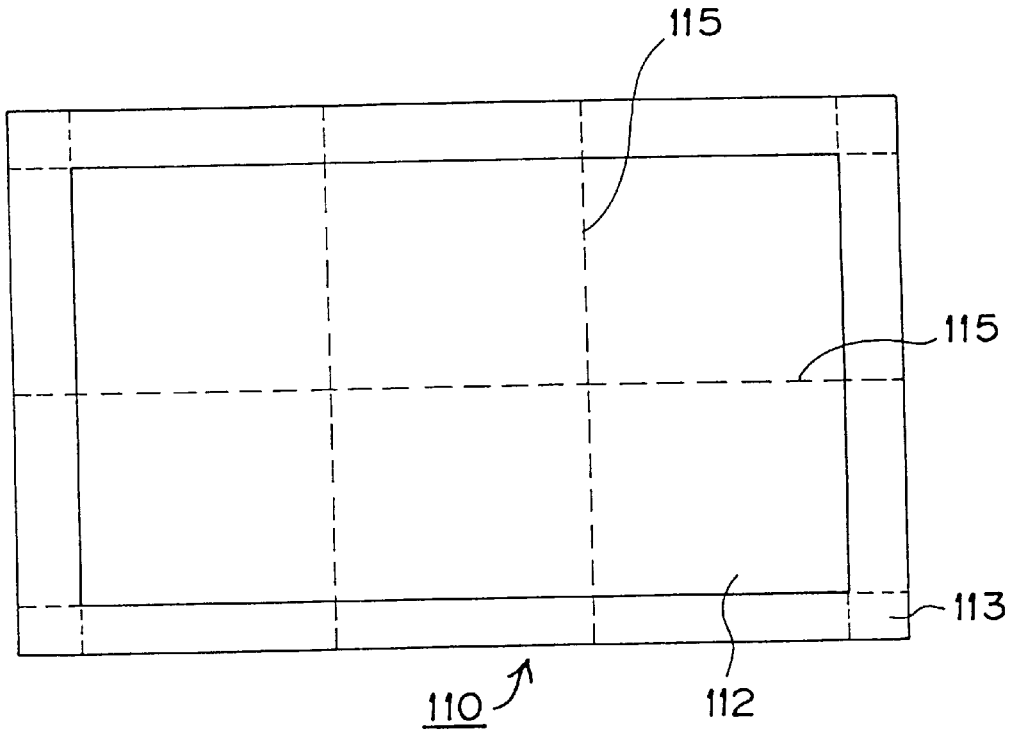
FIG. 11 is a schematic plan view illustrating an eighth embodiment of a roll-shaped image-receiving sheet for thermal transfer printing of the present invention.
Figure 12:
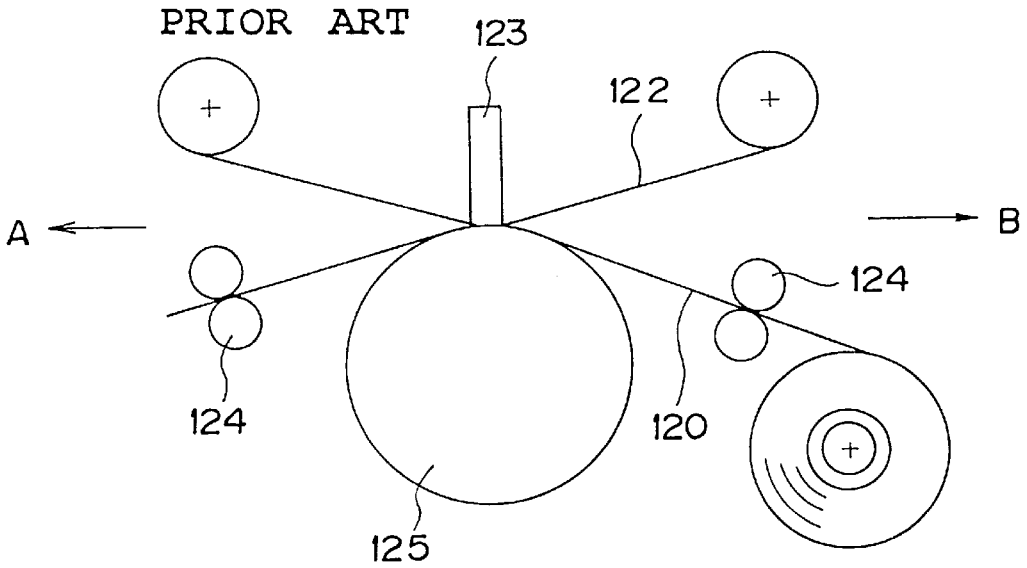
FIG. 12 is a schematic side view illustrating prior art of a process for forming an image onto a roll-shaped image-receiving sheet for thermal transfer printing.

FIG. 11 is a schematic plan view illustrating an eighth embodiment of a roll-shaped image-receiving sheet for thermal transfer printing of the present invention. In the case of seal uses, the cut-lines 115 such as perforations or the like are formed on the roll-shaped image-receiving sheet 110. A plurality of image formed pieces are peeled off from the sheet 110 along the cut-lines 115. Each cut-line 115 may be formed so as to be punched from a front surface of the sheet 110 to a back surface of the sheet 110 in the shape of dotted lines or may be formed in a half cut manner that the cut-line 115 extend from a surface of the sheet 110 to an intermediate part, in depth, of the release sheet 107.

(Antistatic-Treated Layer)

Owing to the prevention of contamination with dust on the image-receiving sheet and the stability of carriage of the sheet in a printer, an antistatic-treated layer containing an antistatic agent described below may be formed onto the color receptor layer of the substrate or the back surface of the substrate.

As an antistatic-treating agent, any antistatic agent such as conventional anion type, cation type, amphoteric ion type or nonionic type may be used. For example, a cation type antistatic agent such as quaternary ammonium salt and polyamine derivative or the like, anion type antistatic agent such as alkylphosphate or the like, and nonionic type antistatic agent such as fatty acid ester may be used.

An antistatic layer may be formed in such a manner that a lubricant such as an organic or an inorganic filler or the like is added to the antistatic agent described above. A composition solution in which those antistatic agent and the lubricant are dissolved or dispersed in a suitable solvent is applied to the color receptor layer or the back surface of substrate by known methods such as gravure coating, gravure reverse coating, roll coating or the like. The an antistatic layer is then dried. The thickness of the antistatic layer after drying is in the range of approximately 0.001 to 0.1 $\mu$m.

(Detection Mark)

A detection mark made on the roll-shaped image-receiving sheet of the present invention shows a starting-position for forming an image of thermal transfer printing.

The shape and color of the detection mark is not limited, as far as it can be detected by a detector. For example, the detection mark 11 in the shape of a line as shown in FIG. 1 or the detection mark 31 in the shape of a slender hole may be used. Further, a circle shape or a shape of bar codes may be adopted for the detection mark. In the case of a line-shaped detection mark, the detection mark 41 may be extended from one side end of the sheet 40 to the other side end thereof as shown in FIG. 4. The detection mark may be formed on the side of the color receptor layer on the sheet 40 or the back side thereof.

Any color can be adopted for a detection mark as far as it can be detected by a detector. For example, a silver color or a black color with a small optical transmission may be used in an optical transmission type detector. A metallic luster color with a high reflection characteristic may be used in an optical reflection type detector.

A detection mark can be formed in such a manner to make a penetrating hole on the roll-shaped image-receiving sheet, or to print a line on the sheet by gravure printing or off-set printing. Further, a foil of vapor deposition film may be transferred to the sheet by heating it, or a vapor deposition film with an adhesive agent on its back side may be put on the sheet. In addition to the those processes, any kinds of processes can be used.

In case of a detection mark being a penetrating hole or being made from the vapor deposition film, the detection mark can be formed in line with the half cut treating. Therefore, productivity becomes higher because of saving a lot of process time of a roll-shaped image-receiving sheet.

A detection mark 11 may be formed only in front of the first image 13 as shown in FIG. 1. The image forming (receiving) position 13 for the first image is detected by reading the detection mark by the detector, and the feeding length of the roll-shaped image-receiving sheet is adjusted in the thermal transfer printer so that the second image forming position 15 or later image forming positions are accurately registered with each image on the thermal transfer sheet.

The detection mark may be formed at any interval of the image-receiving positions. For example, as shown in FIG. 5, the detection mark 51 may be formed at an interval of three image-receiving positions. In this manner, if the detection mark is formed at a predetermined interval of the image-receiving positions, it is prevented that the whole parts of the image-receiving sheet become useless when a shift of the feeding length of the image-receiving sheet is generated in the thermal transfer sheet. In the first embodiment shown in FIG. 1, even if a shift of the first image receiving portion 13 on the image-receiving sheet 10 is very small, a shift after a roll of thermal transfer image-receiving sheet is printed becomes large. However, if the detection mark 51 is formed at an interval of a few of image-receiving portions as shown in FIG. 5, a registration of the image-receiving sheet can be done at the time when a shift corresponding to a few of image-receiving portions is generated.

In order to decrease the shift of image position to the minimum as shown in FIG. 2, the detection mark 21 is preferably formed at an interval of each image-receiving portion.

An image forming position is recognized by the detection mark as described above and, accordingly, a color registration can be done without a shift between each color when each color is printed.

In case of the detection mark being the penetrating hole 31, a cutting position of the roll-shaped image-receiving sheet 30 can be determined by a detection mark when the sheet is cut after printing on the sheet.

A means for detecting the detection mark is not limited as far as it can detect the mark. A penetrating hole is preferable as a detection mark because the hole can be reliably detected by an optical transmission type detector with an error less than an optical reflection type detector.

A detection mark of silver color with vapor deposition luster by printing or a detection mark of a vapor deposition film can be read by an optical reflection type detector.

It is preferable that the detectors described above are located near a supplying portion of the image-receiving sheet before a printing mechanism of the thermal transfer printer in either an optical transmission type detector or an optical reflection type detector.

The image-receiving sheet for thermal transfer printing on the present invention can be adapted for the sheet whose size is determined or not determined.

As the sheet whose size is determined, for example, there exists a sheet for seal use in which the half cut treatment is done on an image-surface side of the sheet 10,30 as shown in FIG. 1 and FIG. 3 and the sheet can be put on something after taking off a peeling paper from back-surface side of each of the sheet 10,30. Further, there also exists a sheet in which a cutting line or a column for writing something thereon are formed on the front or back surface thereof at a predetermined interval as shown in FIG. 2.

FIG. 4 shows an example of a sheet with printed lines in which a cutting line 42 for defining a post card is printed on the front surface of the sheet 40, and a column for a postal code and a position 43 for a postage stamp are printed on the back-surface of the sheet 40.

In a roll-shaped image-receiving sheet of the present invention, it is preferable to have a previously worked or treated part which means a half cut part, the perforation part, the printing parts for the column for a postal code and a postage stamp and the like, and which is formed on the thermal transfer sheet prior to formation of images by thermal transfer printing.

An image-receiving sheet can be prepared without determining an image forming area and can be used as its is. As shown in FIG. 6, a plurality of detection marks are formed at a predetermined interval on the back-side thereof (non-image surface side), and a first detection mark 62 is formed as a starting position for forming images, in front of one of the image receiving areas. The detection mark 63 formed at the back of the area 61 is used as a starting position for forming the next image receiving area 65. The next detection mark 64 is used as a starting position for forming the next image 66.

Figure 13:
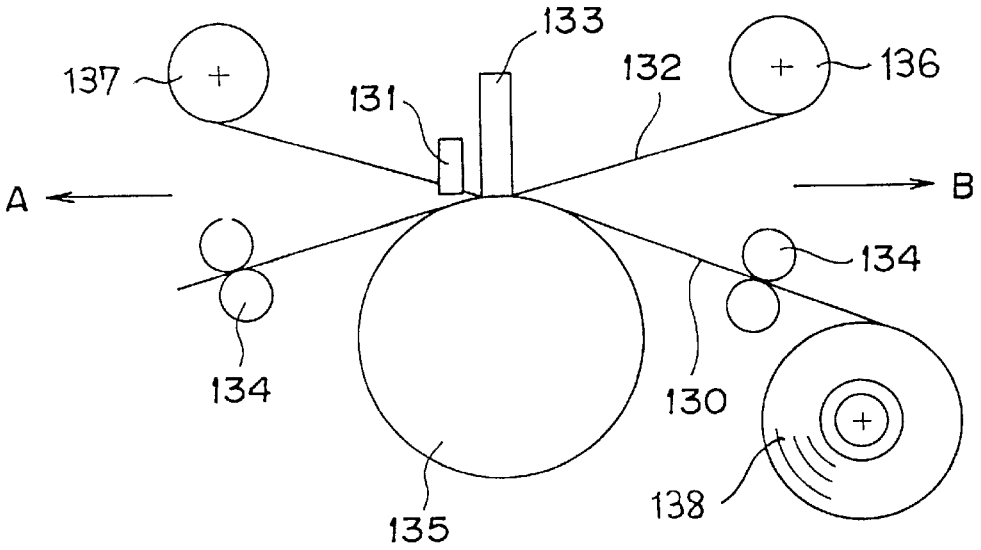
FIG. 13 is a schematic side view illustrating an embodiment of a process for forming an image onto a roll-shaped image-receiving sheet for thermal transfer printing of the present invention.

A process for forming an image onto an image-receiving sheet of the present invention is explained. FIG. 13 is a schematic side view illustrating an embodiment of the process for forming an image onto a roll-shaped image-receiving sheet for thermal transfer printing of the present invention. A detector 131 for reading a detection mark is located above the carrying course of detection marks of image-receiving sheet 130 in a printer.

A first color image is printed as following; the sheet 130 is carried, a detection mark on the sheet 130 is detected by the detector 131, carriage of the sheet 130 is stopped, the sheet 130 is located at a registrated position for forming an image, and a first image is then printed. The first image on the sheet 130 is heated and printed by a thermal-head 133 while the sheet 130 is carried in a direction A in a state wherein a thermal transfer sheet 132 is put on the image-receiving sheet 130. The two sheets are held between the circumferential surface of a platen roller 135 and the thermal head 133.

After printing the first color image, the image-receiving sheet 130 is rewound toward a direction B, and is stopped when the detection mark is detected. At the same time, the thermal transfer sheet 132 Is fed forward so that a second color layer on the sheet 132 is registered with the image-receiving position. The sheet 132 is proceeded at one pitch while being held by two roller 136, 137.

The above-mentioned process for color-printing is repeated for three colors of yellow, magenta and cyan in the case of color printing. Further, the above-mentioned process is repeated for a special color printing such as a black layer or the like and for forming a protection layer on an image on the sheet.

After an image is formed, the image-receiving sheet 130 is cut by a cutter (not shown) in the printer and is the discharged from a discharging outlet in the printer. The detection marks can be used at the time of cutting the sheet.

Concretely, the detector 131 for detecting the detection mark is located around the cutter, the image-receiving sheet 130 is stopped when the detection mark is detected, and is then cut. In this case, the sheet 130 can be correctly cut. The detector 131 for the detection mark is not necessarily located around the cutter, and it may be located at other positions. When the sheet 130' is cut, the other detectors at other positions may be used.

Figure 14:
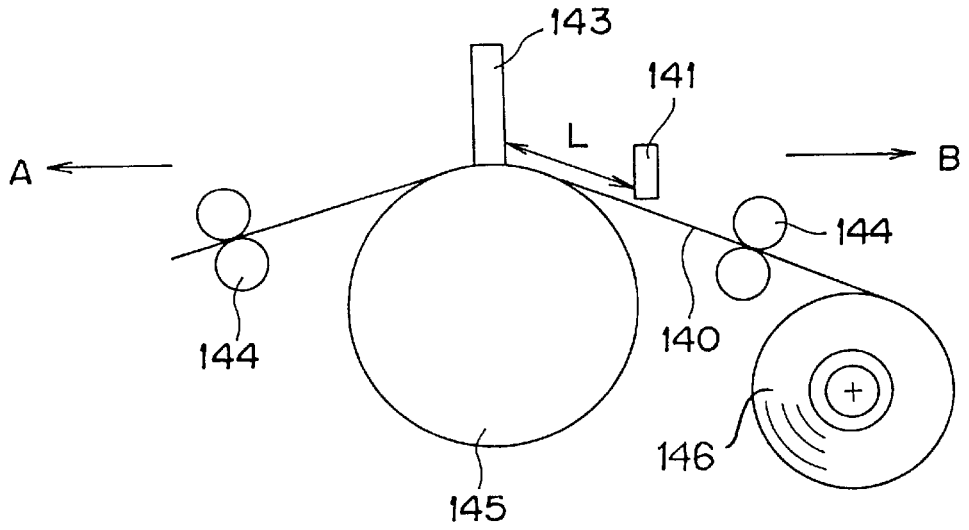
FIG. 14 is a schematic side view illustrating another embodiment of a process for forming an image onto a roll-shaped image-receiving sheet for thermal transfer printing of the present invention.

FIG. 14 is a schematic side view illustrating another embodiment of processes for forming images onto the roll-shaped image-receiving sheet for thermal transfer printing of the present invention. A detector 141, as shown in FIG. 14, may be set in front of the image forming position. In this case, when the image-receiving sheet 30 which has the detection mark 31 in front of the image-receiving forming positions as shown in FIG. 3 is used, the image-receiving sheet 140 is fed for a predetermined length and is then stopped after detecting the detection mark 31 to make a registration between a starting-position of printing of the image-receiving sheet 140 and the position of the thermal head 143.

If the detector 141 is located at the position shown in FIG. 14, the position of each detection mark of the image-receiving sheet may shift to an intermediate position of each image receiving portion as shown in FIG. 15. If the detector 141 is set such a manner that a length(L) between the thermal head 143 of the printer and the detector 141 equals to a length(L') between the starting position of the image-receiving portion on the image-receiving sheet 140 and the detection mark 151, the starting position of the image-receiving portion coincides with the position of the thermal head 143 when the image-receiving sheet 140 is stopped after detecting the detection mark 151 by the detector 141.

Thus, if the relation between the position of the thermal head and the position of the detector and the relation between the length of carrying of the sheet and the position of the detection mark on the image-receiving sheet are good, the position of the detection mark is not necessarily located in front of the starting position for forming an image.

As shown in FIG. 1 and FIG. 5, if the detection mark 11,51 is not formed at an interval of each image-receiving portion on the sheet 10 or 50, with respect to an image-receiving portion adjacent the detection mark 11 or 51, the starting position for forming an image by the way described above can be determined. With respect to an image-receiving portion which is not adjacent the detection mark 11, 51, the image-receiving sheet 10 or 50 may be fed while the sheet 10 or 50 is fed back by a predetermined length in a conventional manner.

In case that the position for forming an image is determined in accordance with the feeding back length of the image-receiving sheet, if the starting position for forming the image on the first image-receiving portion 13 can be detected as shown in FIG. 1, the second image or later images can be formed without a shift on the image-receiving sheet.

If the detection mark 151 is formed on the image receiving sheet 50 at an interval of a few of image-receiving portions as shown in FIG. 5, the starting position for forming an image can be checked at an interval of the image-receiving portions, and then a position for forming an image is hardly shifted. Even if the image forming position is rarely shifted, since the image forming position is adjusted at an interval of a few of image-receiving portions, the whole part of the image-receiving sheet does not become useless.

If an image-receiving sheet is thin in thickness, is weak in strength or has a slippery surface, it is preferable that the image forming position is checked by the detection mark 21, 31 or 41 formed adjacent each printed image as shown in FIGS. 2, 3 and 4. In case that the half cut portion, cutting line portion, printing portion or the like are formed on the image forming portions, it is preferable that the detection mark is formed at an interval of each image. In this manner, a color shift in a multiple color printing and a shift between the image and the half cut portion can be reliably protected.

FIG. 6 is a schematic perspective view illustrating a sixth embodiment of a roll-shaped image-receiving sheet for thermal transfer printing in which the detection marks are formed at a predetermined pitch. The images 61, 65 of irregular sizes can be formed on the image-receiving sheet 60. The detection mark 62, for example, is used for adjusting the starting position of an image when the printing image 61 is formed. The printed image 61 corresponds to four detection marks. Three detection marks except the detection mark 61 are determined in the printer so as to be disregarded, even if three detection marks are detected by the detector.

In case that the next printing image 65 is formed, the detection mark 63 is used for detecting the starting position of the image forming portion.

The image-receiving portion 65 corresponds to two detection marks, a detection mark formed at the center of the image-receiving portion 65 is disregarded even if the detection mark is detected to print the image on the image-receiving sheet 60. The next detection mark 64 is used for detecting the starting position of the following image 66.

Thus, according to the above processes, an image can be determined at an irregular size. After a printing image is formed, the images on the sheet are cut by the cutter in the printer, and are discharged from the printer. In case that the detection marks are used in this manner, it is preferable that the detection mark is formed on the back surface of the image-receiving sheet.

EXAMPLE

Figure 7:
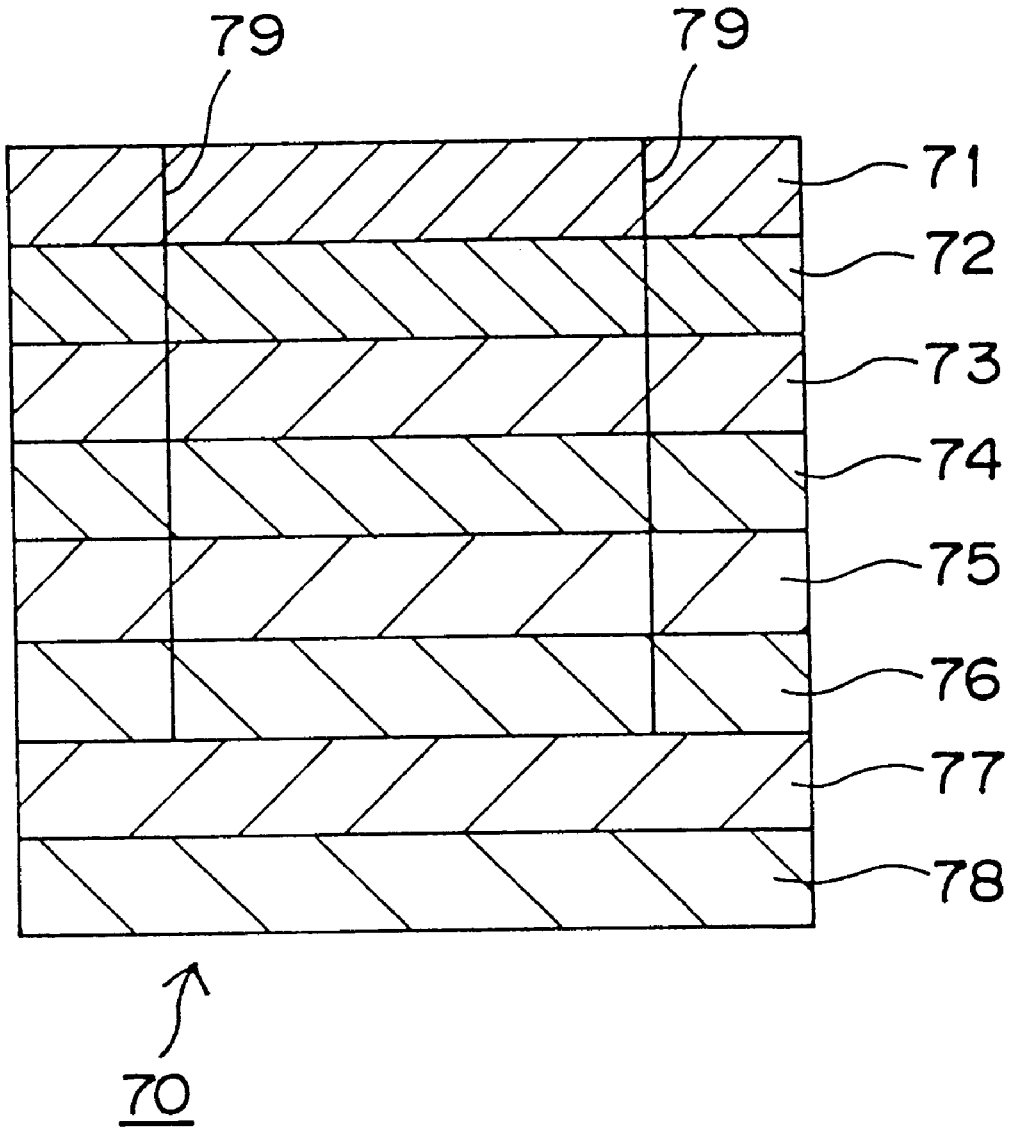
FIG. 7 is a schematic enlarged cross sectional view illustrating an embodiment of constitution of a roll-shaped image-receiving sheet for thermal transfer printing of the present invention.

The present invention will be described hereinbelow in more detail with reference to the following experiments to form an image-receiving sheet 70 having a construction for thermal transfer printing shown in FIG. 7.

Foamed polypropylene 73 having a thickness of 35 $\mu$m ("MW846" manufactured by MOBIL) was used as a substrate. A coating material for forming a color receptor layer having a following composition was applied onto the front surface of the substrate at an applied amount of 4 g/m$^2$ (after drying), and the applied coating material was dried to form the color receptor layer 72 on the front surface of the substrate. Composition of the coating material for forming the color receptor layer 72:

1) Vinyl chloride-Vinyl acetate copolymer resin ("#1000A" manufactured by DENKI KAGAKU Inc.): 40 wt. parts
2) Polyester resin ("BYLON 600" manufactured by TOYOBOSEKI Inc.): 40 wt. parts
3) Vinyl chloride-Styrene-Acrylic copolymer resin ("DENKALUCK #400A" manufactured by DENKI KAGAKU Inc.) 20 wt. parts
4) Vinyl denatured silicone resin ("X-62-1212" manufactured by SHINETU KAGAKU KOGYO Inc.): 10 wt. parts
5) Catalyst ("CAT-PLR-5" manufactured by SHINETU KAGAKU KOGYO Inc.): 5 wt. parts
6) Catalyst ("CAT-PL-50T" manufactured by SHINETU KAGAKU KOGYO Inc.): 6 wt. parts
7) Solvent (Methyl ethyl ketone/Toluene having a weight ratio of 1:1): 400 wt. parts A polyethylene terephthalate (hereinafter referred to as "PET") film 75 having a thickness of 25 $\mu$m ("T-60" of transparent PET manufactured by TORAI Inc.) was laminated on a back surface opposed to the color receptor layer 72 of a substrate 73 with an applied adhesive layer 74. A coating material for forming an adhesive layer 77 having the following composition was applied onto the back surface of the substrate.

Composition of the coating material for forming the adhesive layer 74;

1) Polyurethane resin ("TAKELUCK A-969V" manufactured by TAKEDA YAKUHIN KOGYO Inc.): 30 wt. parts
2) Isocyanate-hardener ("TAKENEIT A-5" manufactured by TAKEDA YAKUHIN KOGYO Inc.): 10 wt. parts
3) Solvent (Ethyl acetate): 80 wt. parts An adhesive agent was applied onto the PET film 75 at an applied amount of 15 g/m$^2$ for forming the adhesive layer 76 having the following composition(after drying at 70° C. and 1 minute)

Composition of the coating material for forming the adhesive layer 76;

1) Acrylic copolymer resin ("SK DYNE 1310L" manufactured by SOKEN KAGAKU Inc.): 48 wt. parts
2) Epoxy resin ("HARDENER E-AX" manufactured by SOKEN YAGAKU Inc.): 0.36 wt. parts
3) Solvent (Ethyl acetate): 51.64 wt. parts A release layer 77 was formed onto the other PET film 78 having a thickness of 38 μm ("Transparent-PET" manufactured by TORAI Inc.) at an applied amount of 0.2 g/m$^2$ (after drying at 130° C. and 30 second). A coating material for forming the release layer 77 having the following composition was applied onto the PET film 78. Thereafter, the release layer 77 of the PET was laminated on the adhesive layer 76.

Composition of the coating material for forming the release layer 77;

1) Additional reaction type-silicon resin for a release paper ("KS-778" manufactured by SHINETU KAGAKU KOGYO Inc.): 32 wt. parts
2) Catalyst ("CAT-PL-8" manufactured by SHINETU KAGAKU KOGYO Inc.): 0.32 wt. parts
3) Solvent (Toluene): 67.68 wt. parts Further, quaternary ammonium salt(diluted solution at a concentration of 1/1000 of "TB-34" manufactured by MATSUMOTO YUSHI SEIYAKU Inc.) for forming an antistatic treated layer 71 was applied onto the color receptor layer 72. The cutting lines 79 of the half cut treatment was extended from the antistatic treated layer 71 to the adhesive layer 76. The pattern of the cutting lines 79 is the same as FIG. 3. Penetrating holes were formed as a detection mark 31 in addition to the cutting line 79.

The formed image receiving sheet was for seal or label use. An image was formed onto the color receptor layer 72 by sublimation type thermal transfer printing. When the image was formed, the image forming position was detected by the detection mark. The position of each image was not shifted. After the image was formed, a seal with an image was peeled off from the border position between the adhesive layer 76 and the release layer 77 on the PET film. The peeled seal can be put on an article.

According to the present invention as described above in detail, an excellent and distinct image without a shift of each color image can be formed on a roll-shaped image-receiving sheet for thermal transfer sheet since a detection mark is formed on the sheet for indicating a formation starting position of a thermal transfer image. Further, the roll-shaped thermal transfer image-receiving sheet according to this invention has a previously worked part such as the half cut portion, perforation portion, and printing portion of postal code writing column and the stamp applying position, and the previous worked portion is reliably registered with a thermal transfer image. In addition, a detection mark can function to detect the cutting position when the sheet is cut after printing a letter or forming an image.

And, according to the process for forming an image onto a roll-shaped image-receiving sheet for thermal transfer printing, the image receiving position of the roll-shaped thermal transfer image-receiving sheet having a detection mark is detected by the detector to be registered with the thermal transfer sheet. Thus, even in case that a roll-shaped image-receiving sheet in which a tension exerted on a carrying roller changes at a carrying time of the sheet, an image without shift can be formed at a predetermined position. A detection mark can be used as a reference for determining the cutting position of the image-receiving sheet.

What is claimed is:

1. A roll-shaped image-receiving sheet for thermal transfer printing, comprising plural pairs of an image-receiving portion and an optically detectable penetrating hole for registration of the image-receiving portion, each of the image-receiving portion having a size capable of completing a printing of each color in one heating process and being formed continuously along a feeding direction of the roll-shaped image-receiving sheet with an interval therebetween, and each of the optically detectable penetrating hole being formed at portion other than the image-receiving portion in constant arrangement with respect to the corresponding image-receiving portion, including a previously worked part formed on said image-receiving sheet, and a seal part comprising at least a color receptor layer, a substrate sheet and an adhesive layer in this order, and a release sheet put on an adhesive layer so as to be separated therefrom, said seal part being half-cut for peeling off said seal part from said sheet.

2. A roll-shaped image-receiving sheet for thermal transfer printing, comprising plural pairs of an image-receiving portion and an optically detectable penetrating hole for registration of the image-receiving portion, each of the image-receiving portion having a size capable of completing a printing of each color in one heating process and being formed continuously alone a feeding direction of the roll-shaped image-receiving sheet with an interval therebetween, and each of the optically detectable penetrating hole being formed at portion other than the image-receiving portion in constant arrangement with respect to the corresponding image-receiving portion, including a seal part having at least a color receptor layer, a substrate and an adhesive layer in this order, and a peeling sheet applied to said adhesive layer so as to be peeled, said seal part having a plurality of parts to be cut by a half-cut treatment in one image-receiving portion, each detection mark in the shape of the hole being formed at an interval of each image-receiving portion for indicating a starting-position for formation of a printing-image.

3. A process for forming an image onto a roll-shaped image-receiving sheet for thermal transfer printing, comprising the steps of:

feeding, to a printer, a roll-shaped image-receiving sheet including plural pairs of an image-receiving portion and an optically detectable penetrating hole for registration of the image-receiving portion, each of the image-receiving portion having a size capable of completing a printing of each color in one heating process and being formed continuously along a feeding direction of the roll-shaped image-receiving sheet with an interval therebetween, and each of the optically detectable penetrating hole being formed at portion other than the image-receiving portion in constant arrangement with respect to the corresponding image-receiving portion;

optically detecting the penetrating hole in the advancing roll-shaped image-receiving sheet by a detector disposed on a carrying passage in the printer;

positioning a printing starting position of the image-receiving portion corresponding to the detected penetrating hole by stopping the penetrating hole to a predetermined position and then printing a first color through a thermal transfer printing;

positioning a printing starting position of the image receiving portion on which the first color printing is made by rolling back the roll-shaped image-receiving sheet after the first color printing, optically detecting the penetrating hole detected in the former detection step and stopping the same on said predetermined position and then printing a second color through a thermal transfer printing; and repeating the step of printing the second color so as to print succeeding colors after the second color.

4. A process for forming an image onto a roll-shaped image-receiving sheet for thermal transfer printing, as claimed in claim 3, said optically detectable penetrating hole is singly formed for the every image-receiving portion.

5. The process according to claim 3, wherein a color image is formed by said sublimation-type thermal transfer printing.

6. The process according to claim 5, wherein a color image is formed by piling up at least yellow-image, magenta-image and cyan-image.

* * * * *